US009316983B2

(12) United States Patent
Sugiyama

(10) Patent No.: US 9,316,983 B2
(45) Date of Patent: Apr. 19, 2016

(54) IMAGE FORMING APPARATUS INCLUDING FIRST DETECTION SENSOR AND SECOND DETECTION SENSOR FOR DETECTING DENSITY DETECTION PATTERN

(71) Applicant: CANON KABUSHIKI KAISHA, Tokyo (JP)

(72) Inventor: Norikazu Sugiyama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/669,674

(22) Filed: Mar. 26, 2015

(65) Prior Publication Data

US 2015/0286179 A1 Oct. 8, 2015

(30) Foreign Application Priority Data

Apr. 2, 2014 (JP) ..... 2014-076457

(51) Int. Cl.
*G03G 15/00* (2006.01)
*G03G 15/01* (2006.01)

(52) U.S. Cl.
CPC ..... *G03G 15/5025* (2013.01); *G03G 15/01* (2013.01); *G03G 15/5058* (2013.01); *G03G 2215/0129* (2013.01); *G03G 2215/0161* (2013.01); *G03G 2215/0164* (2013.01)

(58) Field of Classification Search
CPC ..... G03G 15/5054; G03G 15/5058; G03G 2215/00059; G03G 2215/0158
See application file for complete search history.

(56) References Cited

U.S. PATENT DOCUMENTS

| | | | | |
|---|---|---|---|---|
| 6,381,435 | B2 | 4/2002 | Shinohara et al. | |
| 8,693,902 | B2 | 4/2014 | Watanabe et al. | |
| 2012/0038731 | A1* | 2/2012 | Takahashi et al. | 347/116 |
| 2013/0027722 | A1* | 1/2013 | Tomita | 358/1.9 |

FOREIGN PATENT DOCUMENTS

| | | | | |
|---|---|---|---|---|
| JP | 01-167769 | A | | 7/1989 |
| JP | 11-143171 | A | | 5/1999 |
| JP | 2001-166553 | A | | 6/2001 |
| JP | 2005173253 | A | * | 6/2005 |
| JP | 2011-170165 | A | | 9/2011 |
| JP | 2012-128221 | A | | 7/2012 |
| JP | 2012-159772 | A | | 8/2012 |

* cited by examiner

*Primary Examiner* — Erika J Villaluna
(74) *Attorney, Agent, or Firm* — Fitzpatrick, Cella, Harper & Scinto

(57) ABSTRACT

An image forming apparatus includes: a formation unit configured to form a first detection pattern for density detection on an image carrier for each color used in image formation; and a first sensor and a second sensor configured to detect the first detection pattern formed on the image carrier, the first detection pattern moving in a movement direction of a surface of the image carrier as the image carrier rotates. The formation unit is further configured to form the first detection pattern on the image carrier such that a first detection pattern of an chromatic color is detected by the first sensor and a first detection pattern of an achromatic color is detected by the second sensor, and additionally form a second detection pattern for misregistration detection on the image carrier when forming the first detection pattern on the image carrier.

9 Claims, 8 Drawing Sheets

IMAGE FORMING APPARATUS INCLUDING FIRST DETECTION SENSOR AND SECOND DETECTION SENSOR FOR DETECTING DENSITY DETECTION PATTERN

BACKGROUND OF THE INVENTION

1. Field of the Invention

The present disclosure relates to a density correction technique in an image forming apparatus such as a color printer or a color copier.

2. Description of the Related Art

There are image forming apparatuses that have multiple image forming units and form multi-color images by forming various colors of images with the image forming units and then transferring the images to an intermediate transfer member or a recording material in an overlapped manner. So-called color shift (misregistration), in which relative positions do not match between the images formed by the image forming units, occurs in these types of image forming apparatuses. Misregistration occurs due to error in the attachment of the members constituting the image forming units and due to the relative positions of these members changing due to variation in environmental conditions such as the temperature. Misregistration also occurs due to uneven rotation of rotationally-driven members, variation in the rotation speed, and the like. Also, the color balance (so-called color tone) changes due to variation in the image density for the various colors caused by conditions such as the usage environment and the number of printed sheets.

For this reason, Japanese Patent Laid-Open Nos. 01-167769, 11-143171, and 2001-166553 disclose configurations in which misregistration correction and density correction are performed by forming a misregistration detection pattern for detecting the amount of misregistration and a density detection pattern for detecting the difference between the desired density and the density that is actually formed. In Japanese Patent Laid-Open Nos. 01-167769 and 11-143171, misregistration correction and density correction are independently executed in separate processes (sequences). On the other hand, Japanese Patent Laid-Open No. 2001-166553 discloses a configuration in which the misregistration detection pattern and the density detection pattern are formed in the same sequence, and the two types of correction control are performed together in the same sequence, in order to shorten the downtime caused by these processes.

The misregistration amount caused by uneven rotation of the rotating members, variation in the rotation speed, and the like changes according to change in the speed. For this reason, in order to precisely determine the misregistration amount that has occurred, it is effective to form the misregistration detection pattern multiple times at different positions on the image carriers or the like. If misregistration correction and density correction are performed in the same sequence in order to shorten the downtime, the misregistration detection pattern and the density detection pattern need to be formed within one full rotation of the intermediate transfer member serving as the image carrier, for example. In other words, the length of the misregistration detection pattern needs to be less than or equal to the result of subtracting the length required for forming the density detection pattern from the length of one full rotation of the image carrier.

Accordingly, a short length is preferable for the density detection pattern formation range in the movement direction of the surface of the image carrier. Note that this also applies to the case where misregistration correction and density correction are not executed in the same sequence. This is because shortening the density detection pattern formation range in the movement direction of the surface of the image carrier shortens the time required for density correction control and shortens the downtime.

SUMMARY OF THE INVENTION

According to an aspect of the present invention, an image forming apparatus includes: an image carrier driven to rotate; a formation unit configured to form a first detection pattern for density detection on the image carrier for each color used in image formation; and a first sensor and a second sensor configured to detect the first detection pattern formed on the image carrier, the first detection pattern moving in a movement direction of a surface of the image carrier as the image carrier rotates. The formation unit is further configured to form the first detection pattern on the image carrier such that a first detection pattern of an chromatic color is detected by the first sensor and a first detection pattern of an achromatic color is detected by the second sensor, and additionally form a second detection pattern for misregistration detection on the image carrier when forming the first detection pattern on the image carrier.

Further features of the present invention will become apparent from the following description of exemplary embodiments with reference to the attached drawings.

DESCRIPTION OF THE EMBODIMENTS

Figure 1:
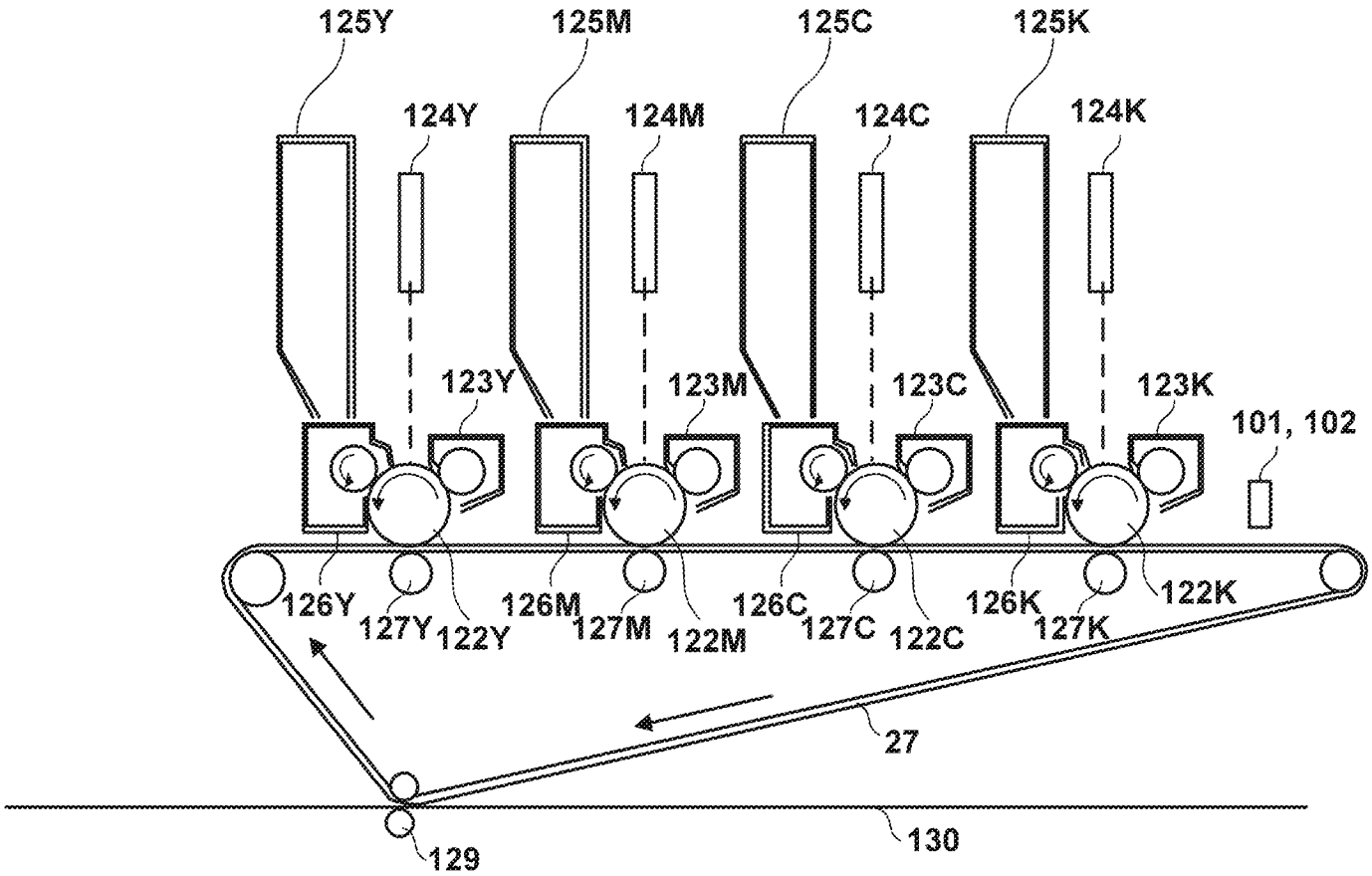
FIG. 1 is a schematic configuration diagram of an image forming apparatus according to an embodiment.

Exemplary embodiments of the present invention will be described below with reference to the drawings. Note that the following embodiments are merely examples, and the present invention is not intended to be limited to the content of these embodiments. Also, constituent elements not necessary to the description of the embodiments are not shown in the drawings described below.

FIG. 1 is a schematic configuration diagram of an image forming apparatus according to an embodiment. Note that Y, M, C, and K appended to reference signs in FIG. 1 indicate that the colors of the toner images formed using the members denoted by the corresponding reference signs are yellow, magenta, cyan, and black. It should also be noted that reference signs not appended with Y, M, C, and K will be used when there is no need to distinguish between colors in the following description. Note also that the arrows in the diagrams indicate the rotation direction of the corresponding members.

Photosensitive members 122 are driven to rotate in the directions of the arrows in this figure. Charging units 123 charge the surfaces of the corresponding photosensitive members 122 to a predetermined potential. Scanning units 124 form electrostatic latent images on the surfaces of photosensitive members 122, which are image carriers, by scanning and exposing the photosensitive members 122 with light based on image data corresponding to the image that is to be formed. Developing units 126 store corresponding colors of toner and form toner images by developing the electrostatic latent images on the corresponding photosensitive members 122 with toner. Toner containers 125 store corresponding colors of toner and supply the toner to the corresponding developing units 126. Primary transfer units 127 transfer the toner images formed on the photosensitive members 122 to an intermediate transfer member 27. At this time, a color image is formed by transferring the various colors of toner images to the intermediate transfer member 27 in an overlapped manner. The intermediate transfer member 27 is driven to rotate in the direction of the arrow in the figure, and conveys the toner image transferred onto its surface to an opposing position on a secondary transfer member 129. The toner image that was transferred onto the intermediate transfer member 27 is transferred by the secondary transfer member 129 to a recording sheet conveyed along a conveying path 130. The toner image that was transferred to the recording sheet is then fixed to the recording sheet by a fixing unit (not shown).

Also, in the present embodiment, sensors 101 and 102 that respectively detect a misregistration detection pattern and a density detection pattern formed by toner on the intermediate transfer member 27 are provided so as to oppose the intermediate transfer member 27. Note that the sensor 101 is provided at a position that opposes the vicinity of one end of the image formation range in the direction orthogonal to the movement direction of the surface of the intermediate transfer member 27, and the sensor 102 is provided at a position that opposes the vicinity of the other end of the image formation range.

Figure 2A:
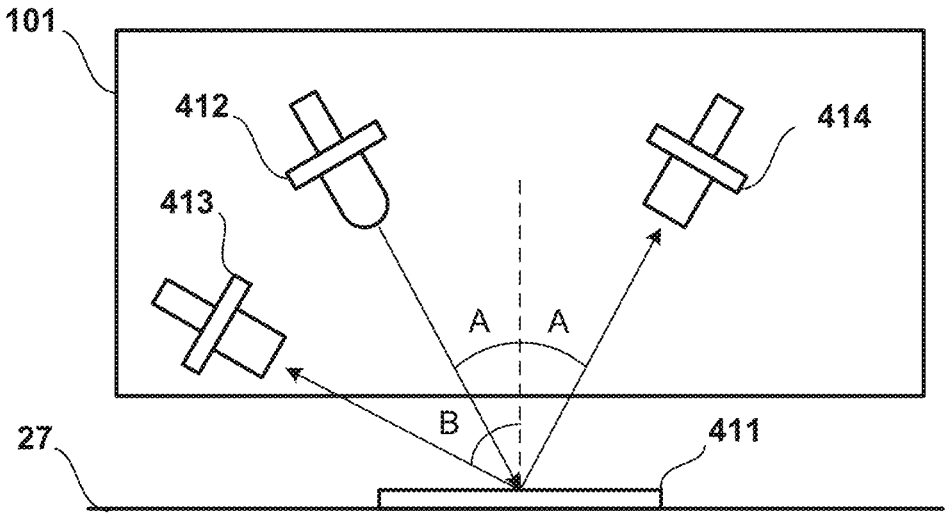
FIGS. 2A and 2B are configuration diagrams of sensors according to an embodiment.
Figure 2B:
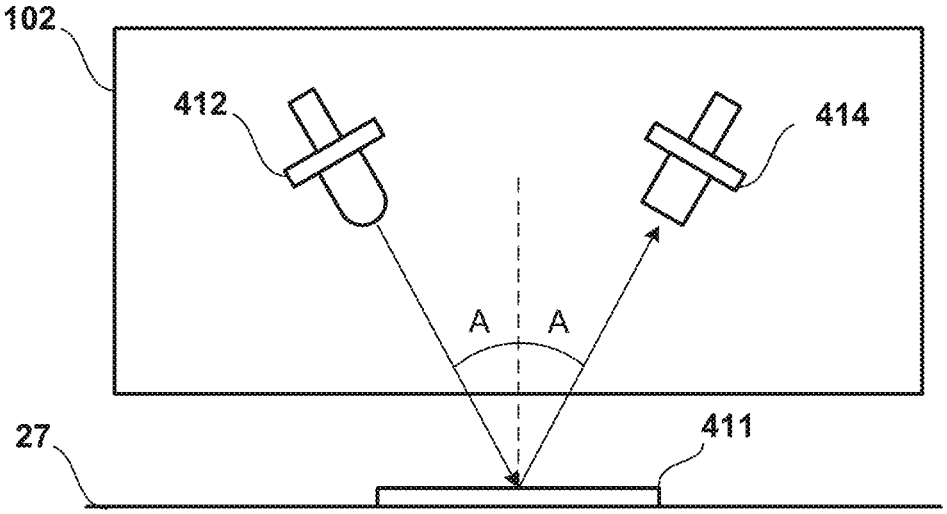

FIG. 2A is a configuration diagram of the sensor 101. A light emitting element 412 emits light at an angle A from the normal direction of the surface of the intermediate transfer member 27. The light emitted by the light emitting element 412 is reflected by the surface of the intermediate transfer member 27 and a toner image 411 formed on the surface of the intermediate transfer member 27. A light receiving element 414 is provided so as to receive light reflected in the direction of the angle A from the normal direction of the surface of the intermediate transfer member 27. Accordingly, the light receiving element 414 mainly receives light that was emitted by the light emitting element 412 and specularly reflected by the surface of the intermediate transfer member 27 or the like. On the other hand, a light receiving element 413 is provided so as to receive light reflected in the direction of an angle B from the normal direction of the surface of the intermediate transfer member 27, which is different from the angle A. Accordingly, the light receiving element 413 mainly receives light that was emitted by the light emitting element 412 and diffusely reflected by the surface of the intermediate transfer member 27 and the like. FIG. 2B is a configuration diagram of the sensor 102. The sensor 102 differs from the sensor 101 in that the light receiving element 413 is not provided. In other words, the sensor 102 has the light receiving element 414 that mainly receives specular reflection light, but does not have the light receiving element 413 for receiving diffuse reflection light.

Figure 3:
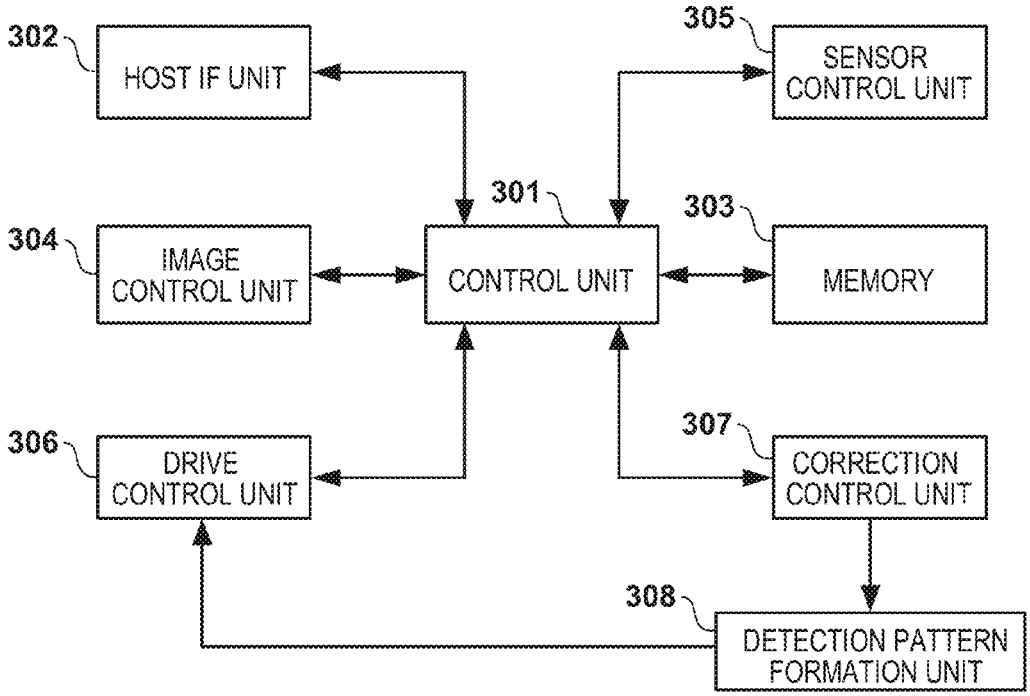
FIG. 3 is a diagram showing a control configuration of the image forming apparatus according to an embodiment.

FIG. 3 is a diagram showing the control configuration of the image forming apparatus according to the present embodiment. A host interface (IF) unit 302 receives image data targeted for printing from an external apparatus. An image control unit 304 receives image data from the host IF unit 302 via a control unit 301, converts the received image data into image data for use by the image forming apparatus, and performs image formation using the members shown in FIG. 1. Note that a drive control unit 306 controls the driving of the members that are driven in image formation, such as the photosensitive members 122 and the intermediate transfer member 27. Also, a sensor control unit 305 controls various types of sensors, including the sensors 101 and 102. A correction control unit 307 executes misregistration correction and density correction. A detection pattern formation unit 308 forms a misregistration detection pattern and a density detection pattern on the intermediate transfer member 27 when misregistration correction and density correction are to be executed. The control unit 301 is the control unit for the entire image forming apparatus, and performs overall management and control of image formation and correction control. Note that a memory 303 is a storage unit, and used by the control unit 301 as a storage region for data and the like when the control unit 301 executes various types of processing.

Figure 5:
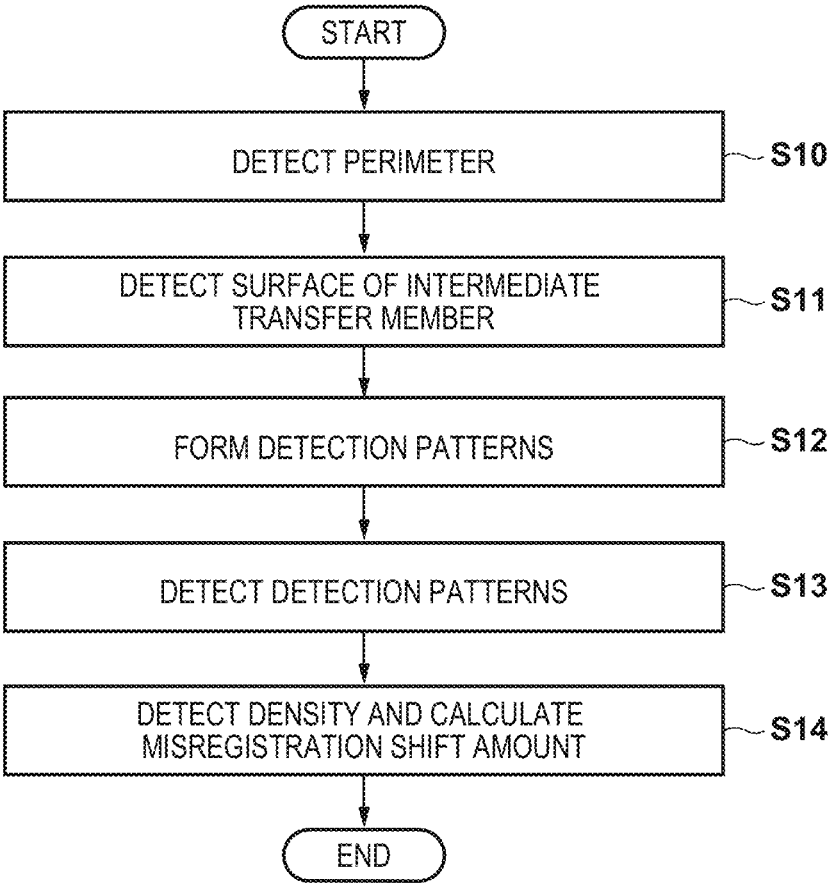
FIG. 5 is a flowchart of correction control according to an embodiment.

FIG. 5 is a flowchart of correction control according to the present embodiment. When correction control starts, in step S10, the correction control unit 307 detects perimeter detection patches formed on the intermediate transfer member 27. Next, in step S11, the correction control unit 307 detects the density of the surface of the intermediate transfer member 27 in order to suppress the influence of the surface of the intermediate transfer member 27, that is to say the background, when performing density detection. Thereafter, in step S12, the correction control unit 307 causes the detection pattern formation unit 308 to form misregistration detection patterns and density detection patterns on the surface of the intermediate transfer member 27. Next, in step S13, the correction control unit 307 detects the density detection patterns and the misregistration detection patterns based on output from the sensors 101 and 102, and stores the detection results in the memory 303. Thereafter, in step S14, the correction control unit 307 obtains the densities of the density detection patterns based on the detection results stored in the memory 303, compares the densities with a target value, and sets image formation conditions such that the density of the image to be formed matches the target density. The correction control unit 307 also obtains misregistration amounts based on the misregistration detection pattern detection results, and sets image formation conditions such that misregistration is reduced.

Figure 6:
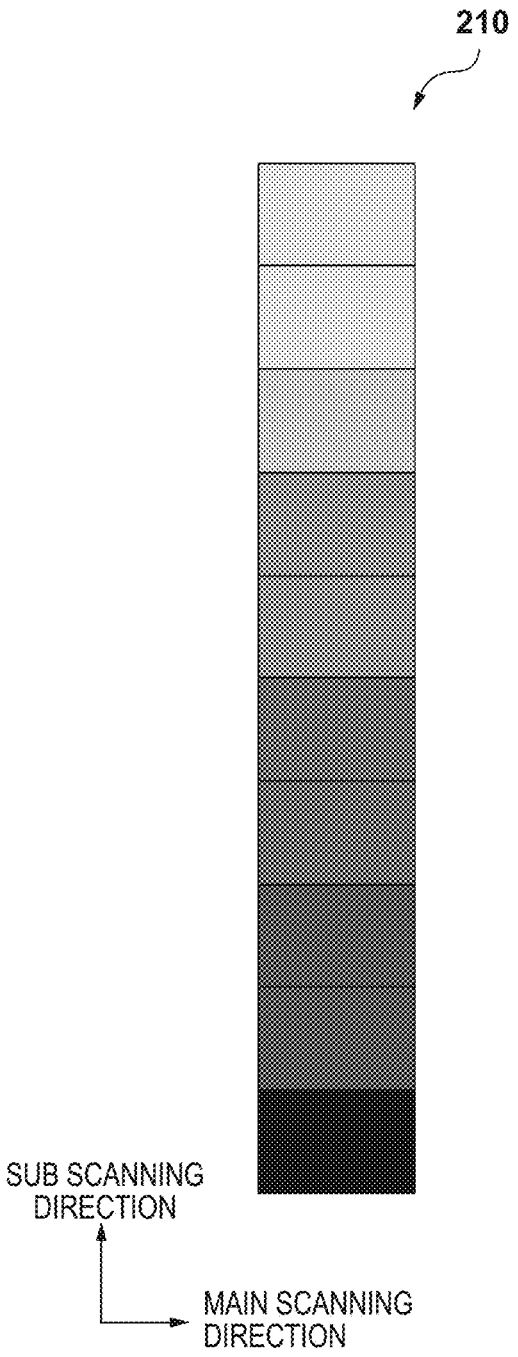
FIG. 6 is a diagram showing a density detection pattern according to an embodiment.
Figure 7:
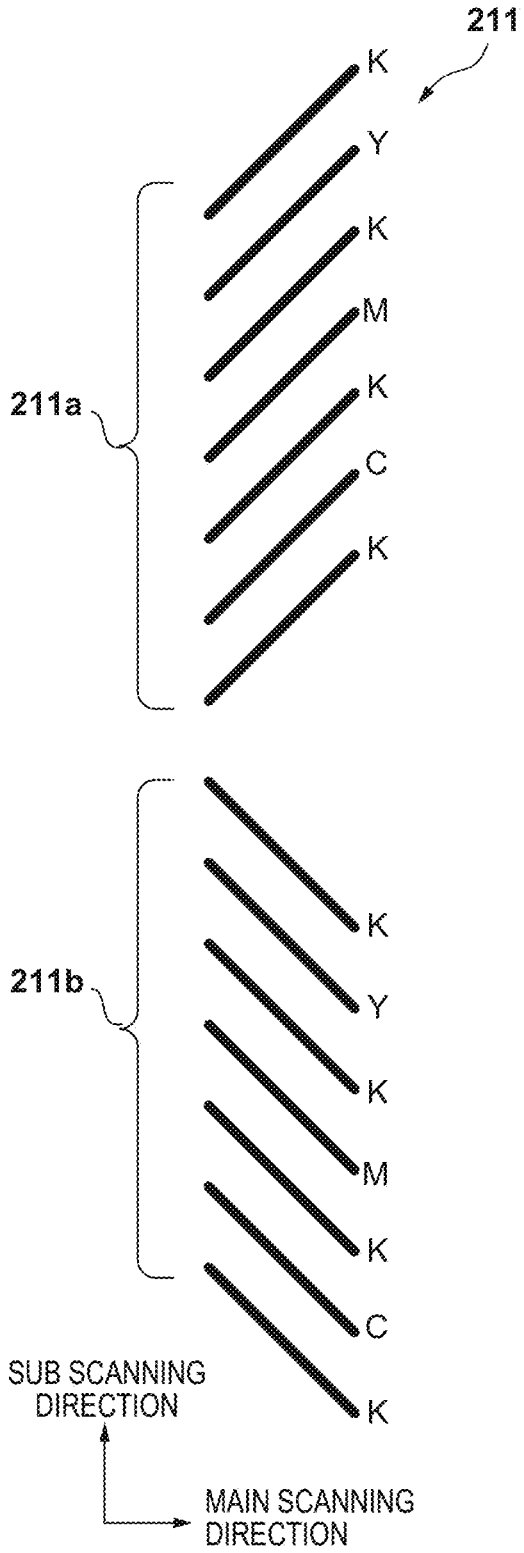
FIG. 7 is a diagram showing a misregistration detection pattern according to an embodiment.

FIG. 6 is a diagram showing a density detection pattern 210 according to the present embodiment. The density detection pattern 210 is a pattern including 10 levels of density for one color, but this number of levels is merely one example. Note that the density detection patterns for yellow, magenta, cyan, and black will be respectively indicated as density detection patterns 210Y, 210M, 210C, and 210K in the following description. Also, FIG. 7 shows a misregistration detection pattern 211 according to the present embodiment. Note that the letters Y, M, C, and K shown to the side of the diagonal line-shaped toner images in FIG. 7 indicate that the colors of the corresponding toner images are respectively yellow, magenta, cyan, and black. As shown in FIG. 7, the misregistration detection pattern 211 includes a pattern 211*a* and a pattern 211*b*. Note that since the black toner image is used as the reference in the present embodiment, these patterns are made up of yellow, magenta, and cyan toner images each formed between black toner images. Although details of the method for obtaining the misregistration amount will not be described here, the misregistration amount for the sub-scanning direction (the direction in which the surface of the intermediate transfer member 27 moves) can be obtained by measuring the distance between the black toner image and each of the yellow, magenta, and cyan toner images in the sub-scanning direction. Also, the distances between the toner images of corresponding colors in the pattern 211*a* and the pattern 211*b* change in proportion to the misregistration in the main-scanning direction. Accordingly, the misregistration amount in the main-scanning direction can be obtained by measuring the distances between the toner images of corresponding colors in the pattern 211*a* and the pattern 211*b*. Also, by forming the misregistration detection pattern 211 in the vicinity of the end portions of the image formation region in the main-scanning direction and obtaining the misregistration amount in the main-scanning direction, it is possible to measure a deviation amount from the reference value of the length in the main scanning-direction.

Figure 10:
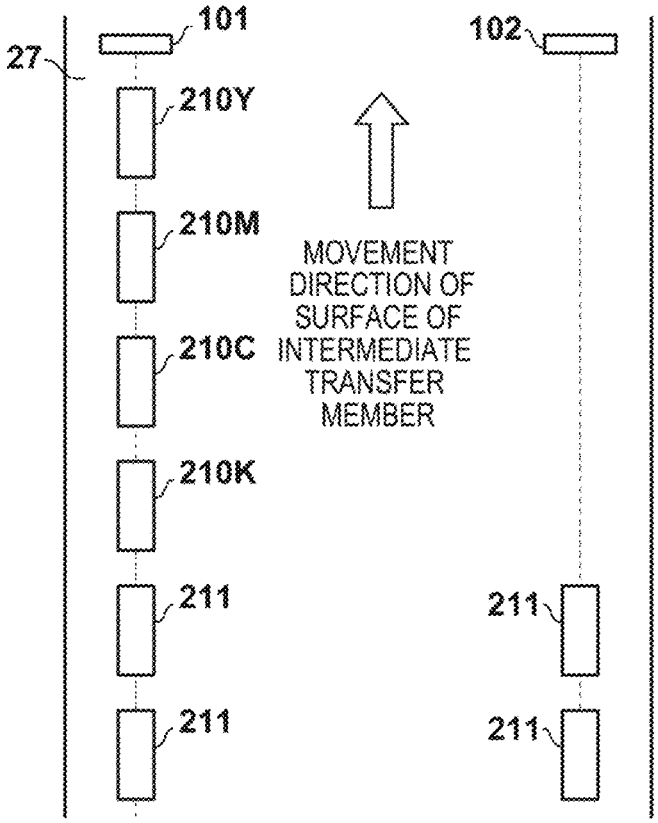
FIG. 10 is a diagram showing formed density detection patterns and misregistration detection patterns.

FIG. 10 shows an example of a state in which detection patterns have been formed on the intermediate transfer member 27. First, in misregistration correction, the deviation amount from the reference value of the length of the scan line needs to be measured. Accordingly, the misregistration detection patterns 211 are formed in the vicinity of the two ends of the image formation region in the main-scanning direction. Also, two sensors are provided in order to detect these misregistration detection patterns 211 formed on the two sides of the intermediate transfer member 27.

Here, the density is obtained using the amount of specular reflection light when irradiating the density detection pattern 210 with light. However, it is difficult to cause the light receiving element 414 to receive only specular reflection light from the density detection pattern 210, and the light receiving element 414 receives diffuse reflection light in addition to specular reflection light. Accordingly, in order to precisely detect the density, it is necessary to measure the amount of diffuse reflection light and then obtain the specular light amount by subtracting the amount of diffuse reflection light from the received light amount of the light receiving element 414. In other words, the sensor 101 shown in FIG. 2A needs to be used in order to detect the density. On the other hand, the misregistration amount need only be detected at the positions of the various colors of toner images in the misregistration detection patterns 211, and the amount of diffuse reflection light does not need to be measured. In other words, the sensor 102 shown in FIG. 2B that is not provided with the light receiving element 413 can be used in misregistration detection. Accordingly, in FIG. 10, the density detection patterns 210 are formed on only the side detected by the sensor 101.

Figure 4A:
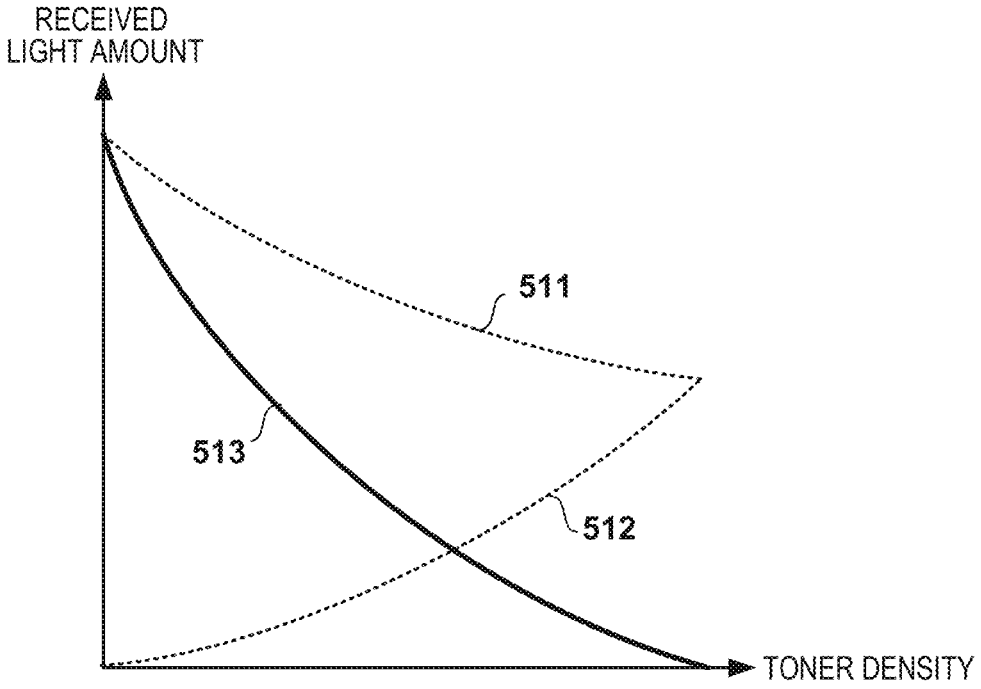
FIGS. 4A and 4B are diagrams showing a relationship between image densities and the received light amounts of light receiving elements according to an embodiment.

FIG. 4A shows the received light amounts of the light receiving element 414 and the light receiving element 413 in the case where chromatic color toner images are formed on the intermediate transfer member 27 and detected by the sensor 101, for example. The chromatic colors referred to here are yellow, magenta, and cyan in the present embodiment. Note that reference sign 511 in FIG. 4A indicates the received light amount of the light receiving element 414, and reference sign 512 indicates the received light amount of the light receiving element 413. Also, the toner density in FIG. 4A is a value obtained by subtracting the density of the recording sheet from the optical density of the density detection pattern 210 after fixing to the recording medium. It can be understood from FIG. 4A that the received light amount 512 of the light receiving element 413 increases as the toner density increases. This is because the amount of diffuse reflection light increases as the toner density increases. On the other hand, the received light amount 511 of the light receiving element 414 decreases as the toner density increases. This is because the amount of specular reflection light decreases as the toner density increases. However, if the toner density increases, and the amount of diffuse reflection light increases, the amount of diffuse reflection light that enters the light receiving element 414 increases as well. For this reason, the density is detected by subtracting a value corresponding to the received light amount of the light receiving element 413 from the received light amount of the light receiving element 414 as described above, thus making it possible to correctly detect the amount of specular reflection light from the toner images. Reference sign 513 in FIG. 4A shows the amount of specular reflection light from the toner images obtained by subtracting a value corresponding to the received light amount of the light receiving element 413 from the received light amount of the light receiving element 414.

Figure 4B:
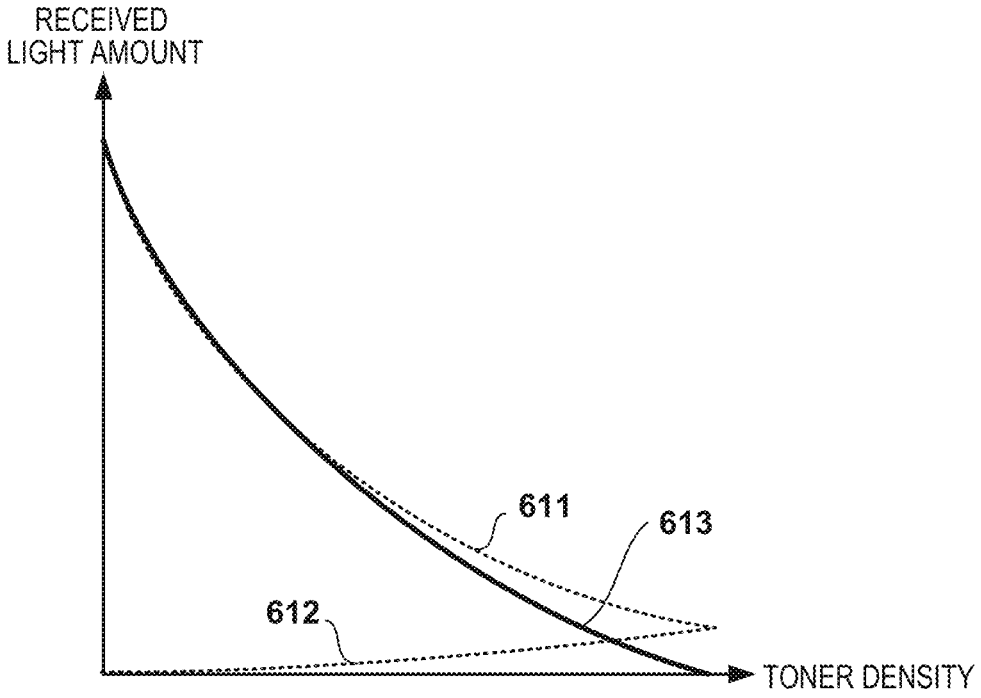

On the other hand, FIG. 4B shows the received light amounts of the light receiving element 414 and the light receiving element 413 in the case where an achromatic color toner image is formed on the intermediate transfer member 27 and detected by the sensor 101, for example. The achromatic color referred to here is black in the present embodiment. Note that reference sign 611 in FIG. 4B indicates the received light amount of the light receiving element 414, and reference sign 612 indicates the received light amount of the light receiving element 413. It should also be noted that reference sign 613 in FIG. 4B is the result of subtracting a value corresponding to the received light amount of the light receiving element 413 from the received light amount of the light receiving element 414. In comparison with the case of the chromatic color toner images shown in FIG. 4A, even if the toner density is raised in the achromatic color toner image, the amount of diffuse reflection light does not increase very much. Accordingly, as shown in FIG. 4B, the received light amount of the light receiving element 414 indicated by reference sign 611 and the amount of specular reflection light from the toner image indicated by reference sign 613 are substantially the same value relative to the toner density. In other words, when detecting the density of the achromatic color toner image, the density can be precisely detected without obtaining the difference between two light receiving elements, unlike the chromatic color toner images. By focusing on this point, the present embodiment reduces the range in the sub-scanning direction in which the density detection pattern 210 is formed.

Figure 8:
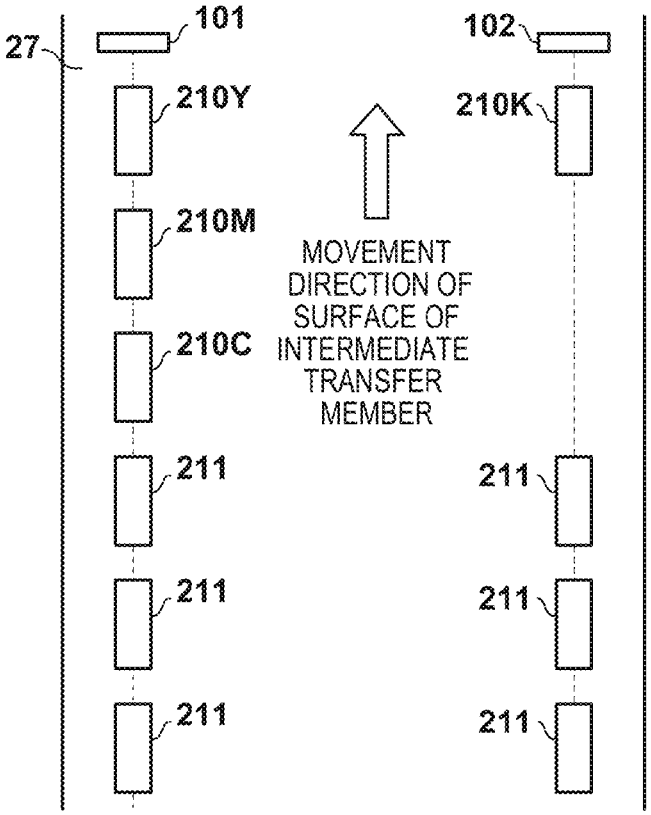
FIG. 8 is a diagram showing formed density detection patterns and misregistration detection patterns according to an embodiment.

FIG. 8 shows a state in which density detection patterns 210 and misregistration detection patterns 211 have been formed on the intermediate transfer member 27 in the present embodiment. As described above, the light receiving element 413 is needed for precise density detection in the case of the chromatic color density detection patterns 210Y, 210M, and 210C, and therefore these detection patterns are formed on the side detected by the sensor 101. On the other hand, precise density detection can be performed without the light receiving element 413 in the case of the achromatic color density detection pattern 210K, and therefore this detection pattern is formed on the side detected by the sensor 102. Also, the misregistration detection pattern 211 is repeatedly formed multiple times after the formation of the density detection pattern 210.

In the present embodiment, given that the density of the achromatic color density detection pattern 210K can be precisely detected with the sensor 102 as well, it is detected using the sensor 102. Accordingly to this configuration, the range in the sub-scanning direction in which the density detection pattern 210 is formed can be reduced compared to the configuration shown in FIG. 10. This therefore makes it possible to reduce the amount of time needed to detect the density detection patterns 210 for the various colors. Also, in the case where misregistration correction and density correction are performed in the same sequence, the number of times that the misregistration detection pattern 211 is formed can be increased. For example, with the configuration shown in FIG. 8, the misregistration detection pattern 211 can be formed one more time than in the case of the configuration shown in FIG. 10.

Note that in FIG. 8, with respect to the sub-scanning direction, the formation range of the density detection pattern 210K is included in the formation range of all of the density detection patterns 210Y, 210M, and 210C. However, with respect to the sub-scanning direction, the formation range of the density detection pattern 210K and the formation range of all of the density detection patterns 210Y, 210M, and 210C need only at least have an overlapping portion, i.e. partially overlap each other. This makes it possible to reduce the range in the sub-scanning direction in which the density detection pattern 210 is formed in the case of the configuration shown in FIG. 10.

Second Embodiment

Next, a second embodiment will be described with focus on differences from the first embodiment. In FIG. 8, the timing of detection of the misregistration detection patterns 211 is approximately the same for the sensor 101 and the sensor 102. In other words, the formation start position of the misregistration detection pattern 211 in the sub-scanning direction is the same on both sides. Accordingly, as shown in FIG. 8, a blank region exists between the density detection pattern 210K and the misregistration detection pattern 211 on the side detected by the sensor 102.

Figure 9:
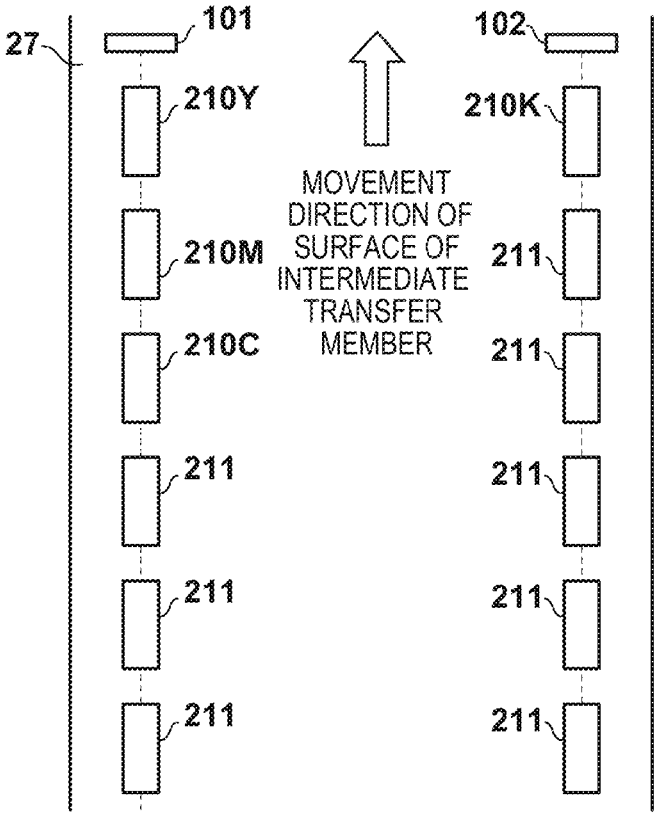
FIG. 9 is a diagram showing formed density detection patterns and misregistration detection patterns according to an embodiment.

In the present embodiment, as shown in FIG. 9, the misregistration detection pattern 211 is formed in the blank region shown in FIG. 8 as well. By forming the detection patterns as shown in FIG. 9, it is possible to form more misregistration detection patterns 211, and it is possible to raise the precision of misregistration correction. In other words, the detection patterns are formed such that, with respect to the sub-scanning direction, the formation range of the misregistration detection pattern 211 detected by the sensor 102 and the formation range of the density detection pattern 210 detected by the sensor 101 partially overlap each other. According to the configuration, more misregistration detection patterns 211 can be formed than in the case of the configuration shown in FIG. 8.

Note that although black is used as the reference color for misregistration control in the above embodiments, another color can be used as the reference color. Also, although the four colors yellow, magenta, cyan, and black are used in image formation in the above embodiments, the colors that are used and the number thereof are not limited to the above embodiments. Moreover, although the image forming apparatus is of the so-called tandem type in the above embodiments, the present invention is not limited to this, and it may be of the rotary type, for example. Furthermore, although the density detection patterns 210 are formed downstream of the misregistration detection pattern 211 in the movement direction of the intermediate transfer member 27 in the above embodiments, this may be reversed. Also, the same misregistration detection pattern 211 is repeatedly formed in the above embodiments. However, in the case where the region in which the last misregistration detection pattern can be formed, which is limited by the circumferential length of the intermediate transfer member 27, is shorter than the length of the misregistration detection pattern 211, a misregistration detection pattern different from the misregistration detection pattern 211 may be formed. For example, it is possible to form a misregistration detection pattern that does not include the cyan toner image. In other words, it is possible to use a detection pattern for detecting misregistration regarding a portion of the colors rather than all of the colors.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076457, filed on Apr. 2, 2014, which is hereby incorporated by reference herein in its entirety.

What is claimed is:

1. An image forming apparatus comprising:

an image carrier driven to rotate;

a formation unit configured to form a first detection pattern for density detection on the image carrier for each color used in image formation, the first detection pattern including a chromatic color first detection pattern and an achromatic color first detection pattern; and a first sensor and a second sensor configured to detect the first detection pattern formed on the image carrier, the first detection pattern moving in a movement direction of a surface of the image carrier as the image carrier rotates, wherein the formation unit is further configured to form a second detection pattern for misregistration detection on the image carrier, the first sensor is further configured to detect the chromatic color first detection pattern and the second detection pattern, the second sensor is further configured to detect the achromatic first detection pattern and the second detection pattern, and the first detection pattern and the second detection pattern are formed such that the second sensor detects the achromatic color first detection pattern and the second detection pattern at the same time the first sensor detects the chromatic color first detection pattern.

2. The image forming apparatus according to claim 1, wherein the formation unit is further configured to form the second detection pattern on the image carrier such that the first sensor and the second sensor detect the second detection pattern.

3. The image forming apparatus according to claim 2, wherein with respect to the movement direction of the surface of the image carrier, a range of the image carrier in which the chromatic color first detection pattern is formed and a range of the image carrier in which the second detection pattern detected by the second sensor is formed partially overlap each other.

4. The image forming apparatus according to claim 1, wherein the first sensor and the second sensor are further configured to detect the first detection pattern formed at different positions on the image carrier in a direction orthogonal to the movement direction of the surface of the image carrier.

5. The image forming apparatus according to claim 1, wherein with respect to the movement direction of the surface of the image carrier, a range of the image carrier in which the achromatic color first detection pattern is formed is included in a range of the image carrier in which the chromatic color first detection pattern is formed.

6. The image forming apparatus according to claim 1, wherein the first sensor has a first light receiving element for receiving specular reflection light and a second light receiving element for receiving diffuse reflection light, and the second sensor has a third light receiving element for receiving specular reflection light.

7. The image forming apparatus according to claim 6, further comprising a detection unit configured to detect a density of the chromatic color first detection pattern based on a received light amount of the first light receiving element and a received light amount of the second light receiving element, and to detect a density of the achromatic color first detection pattern based on a received light amount of the third light receiving element.

8. The image forming apparatus according to claim 6, wherein the first sensor has a first light emitting element that emits light toward the image carrier, the second sensor has a second light emitting element that emits light toward the image carrier, the first light receiving element receives specular reflection light from the image carrier corresponding to light emitted by the first light emitting element, the second light receiving element receives diffuse reflection light from the image carrier corresponding to light emitted by the first light emitting element, and the third light receiving element receives specular reflection light from the image carrier corresponding to light emitted by the second light emitting element.

9. The image forming apparatus according to claim 1, wherein the formation unit is further configured to form a third detection pattern for misregistration detection on the image carrier, a number of colors used in the third detection being less than a number of colors used in the second detection pattern.

* * * * *